US010647562B2

(12) United States Patent
Clüsserath et al.

(10) Patent No.: US 10,647,562 B2
(45) Date of Patent: May 12, 2020

(54) FILLING VALVE

(71) Applicant: KHS GmbH, Dortmund (DE)

(72) Inventors: Ludwig Clüsserath, Bad Kreuznach (DE); Max Stolz, Langenlonsheim (DE); Manfred Härtel, Weilerbach (DE); Dieter-Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 303 days.

(21) Appl. No.: 15/512,655

(22) PCT Filed: Sep. 17, 2015

(86) PCT No.: PCT/EP2015/071371
§ 371 (c)(1),
(2) Date: Mar. 20, 2017

(87) PCT Pub. No.: WO2016/042102
PCT Pub. Date: Mar. 24, 2016

(65) Prior Publication Data

US 2017/0283233 A1 Oct. 5, 2017

(30) Foreign Application Priority Data

Sep. 18, 2014 (DE) ..... 10 2014 113 488

(51) Int. Cl.
*B67C 3/26* (2006.01)
*B67C 3/28* (2006.01)

(52) U.S. Cl.
CPC ..... *B67C 3/2608* (2013.01); *B67C 3/281* (2013.01)

(58) Field of Classification Search
CPC ..... B67C 3/28; B67C 3/281; B67C 3/286; B67C 3/2608
USPC ..... 141/39, 57, 146, 255, 258, 264, 301
See application file for complete search history.

(56) References Cited

U.S. PATENT DOCUMENTS

| | | | |
|---|---|---|---|
| 2,954,806 | A | 10/1960 | Kerr |
| 5,137,187 | A | 8/1992 | Nichols et al. |
| 5,878,992 | A | 3/1999 | Edwards et al. |

(Continued)

FOREIGN PATENT DOCUMENTS

| | | |
|---|---|---|
| DE | 19 80 484 | 3/1968 |
| DE | 28 37 298 | 3/1980 |

(Continued)

*Primary Examiner* — Marina A Tietjen
*Assistant Examiner* — Paul J Gray
(74) *Attorney, Agent, or Firm* — Occhiuti & Rohlicek LLP

(57) ABSTRACT

A filling valve includes a valve seat, an axially-movable valve tappet extending through the valve seat and having an axial portion that defines a product-delivery space through which filling product flows, and axially-displaced first and second seal-seats disposed so that liquid product flows from the first seal-set, through the product-delivery space, to the second seal-seat and out through an outlet. The first seal-seat and the second seal-seat are arranged on the valve tappet in such a way that, in response to a closing movement of the valve tappet, the first seal-seat closes before the second seal-seat, and wherein the first seal-seat, after having been closed as a result of the closing movement, permits further axial movement of the valve tappet to permit closing of the second seal-seat.

20 Claims, 2 Drawing Sheets

(56) References Cited

U.S. PATENT DOCUMENTS

| | | | | |
|---|---|---|---|---|
| 7,963,305 | B2 * | 6/2011 | Lupi | B67C 3/20 141/255 |
| 8,109,416 | B2 | 2/2012 | Morand | |
| 2003/0196721 | A1 * | 10/2003 | Graffin | B67C 3/26 141/302 |
| 2012/0313027 | A1 * | 12/2012 | Welchner | F16J 15/024 251/318 |

FOREIGN PATENT DOCUMENTS

| | | |
|---|---|---|
| DE | 195 39 921 | 2/1997 |
| DE | 19628375 | 1/1998 |
| DE | 10 2010 012577 | 9/2011 |
| EP | 1 143 176 | 10/2001 |
| EP | 1 340 713 | 9/2003 |
| JP | H1172166 | 3/1999 |

* cited by examiner

FILLING VALVE

RELATED APPLICATIONS

This is the national stage under 35 USC 371 of international application PCT/EP2015/071371, filed Sep. 17, 2015, which claims the benefit of the Sep. 18, 2014 priority date of German application DE 10-2014-113-488.5, the contents of which are herein incorporated by reference.

FIELD OF INVENTION

The invention relates to a filling valve used to fill containers with liquid filling-product that may contain particles and long fruit fibers.

BACKGROUND

Filling machines rely on filling valves to fill bottles. In many cases, filling valves that work with some filling products do not work with other filling products. These difficulties arise from the nature of the filling products. For examples, some filling products have suspended solids, such as fruit fibers. Other filling products have low viscosities.

SUMMARY

An object of the invention is to provide a filling valve that can both fill with products with solid particles, such as small pieces of fruit, as well as fill with products of different viscosities.

In one aspect of the invention, the filling valve has at least one valve tappet that is arranged to be movable axially through an axially-extending channel along a valve seat that defines an inner-wall of the valve. Liquid filling-product thus flows along an axial portion of the valve tappet through the axially-extending channel. The liquid filling product flows from a first seal-seat to a second seal-seat that is formed at an outlet end of the filling valve.

In some embodiments, the axially-extending channel is an annular gap. However, it can also be any lateral channel parallel to the filling valve axis.

The filling valve has a first seal-seat and a second seal-seat that are axially displaced from each other, with the second-seal seat being downstream of the first seal-seat. In some embodiments, the first seal-seat comprises an elastic seal-element. The first seal-seat and the second seal-seat are arranged in such a way that, when the valve tappet executes a closing movement, the first seal-seat closes before the second seal-seat. Moreover, the first seal-seat, after having been closed, allows further axial movement of the valve tappet in the closure direction until the second seal-seat also closes. As a result, closing the filling valve is a two-stage or two-phase endeavor with a time delay between a first phase and a second phase thereof.

In the foregoing configuration, the second seal-seat no longer leaves a gap open, but is likewise closed after the first seal-seat, possibly in its own movement step. This means that after closing the first seal-seat, the filling process is ended. But any product present upstream of the second seal-seat and downstream of the first seal-set remains there because the gap that remains at the second seal-seat is so small that it functions as a gas barrier and counteracts any ingress of gas. With the closing of the second seal-seat, which only takes place after a time delay, no more product sprays into the bottle located below, or onto the surrounding area. This is the case even if the liquid filling-product has very low viscosity.

The time delay before the second seal-seat closes means that any filling product present in the axially-extending channel cannot escape. Nor can any gas rise therein. The filling valve's ability to fill is therefore independent of the filling product's viscosity, at least within the viscosity ranges that are usual for drinks.

According to the invention, therefore, after having reached the filling quantity of a container that is to be filled, the valve tappet moves far enough to close first seal-seat, thus leaving a gap in the second seat. This effectively forms a gas barrier. As a result, the filling valve is able to end the filling process without the filling product being sprayed.

A short time later, i.e. preferably 30-300 milliseconds later, further movement of the valve tappet closes the second seal-seat. The time period between the closing of the first seal-seat and the second seal-seat is so short that no gas can rise into the axially-extending channel between the two seal seats. This avoids premature emptying of the product present therein, even when the filling product has very low viscosity. The further movement of the valve tappet after having closed the first seal-seat is preferably less than 2.5 millimeters. An appropriately designed first seal-seat will accommodate this further movement as described below.

In some embodiments, the axially-extending channel between the first seal-seat and the second seal-seat forms an annular gap. This annular gap is large enough to permit unimpeded flow of liquid filling products that have solid constituents, such as small pieces of fruit, as well as for liquid filling-products with high viscosity. Due to the control of the second seal-seat, the viscosity dependence between the annular gap and the gap at the second seal-seat no longer applies because the second seal-seat closes completely shortly after the first seal-seat closes.

The resulting filling-valve allows the filling jet to be adjusted optimally for very low turbulence and minimal foam formation, as well as high discharge capacity and the processing of large particles. The impediment of having to take account of a functioning gas barrier no longer applies. This means that products with very differing viscosities can be handled.

There are various different possibilities for configuring the first seal-seat to allow it to accommodate further axial movement of the valve tappet in the closing direction.

In some embodiments, the first seal-seat comprises at least one highly-elastic sealing-element that, after the closing of the first seal-seat, can be deformed to such an extent that it takes part in the axial movement of the valve tappet without losing the sealing effect in reciprocal action with the other sealing element of the first seal-seat. Such a configuration of the first seal-seat requires no moving parts at the first seal-seat. The further axial movement of the valve tappet can readily be accommodated based solely on the flexibility or deformability of the first seal-seat and on the highly elastic properties of one or both sealing elements thereof.

In other embodiments, at least one of the sealing elements of the first seal-seat is arranged such that it can be axially displaced, either at the valve tappet or at the valve seat. This axial displacement capability makes it possible for the corresponding axially-displaceable sealing-element, after the closing of the first seal-seat, to move along with the axial movement of the valve tappet without breaking its seal. It is therefore possible, for example, for the axially-displaceable sealing-element of the first seal-seat to be held on an axially-movable carrier that is mounted such as to be axially-movable either at the valve tappet or at the valve seat. The carrier can be formed, for example, by a metal sleeve, which can be provided such as to slide easily on the valve tappet or the valve seat.

Preferably, a carrier, or the axially-movable sealing-element, is held in a resting position by a spring such that the further movement of the valve tappet after the closing of the first seal-seat is realized by having the carrier be pressed out of its resting position against the force of the spring. At the opening of the filling valve, i.e., during actuation of the valve tappet away from the outlet end, the second seal-seat opens first. Following this, between these two actions, the carrier returns to its resting position. Such a device is reliable and retains its functional capacity even after frequent actuation of the valve tappet.

In some embodiments, the carrier is sealed against the valve tappet or valve seat by folding bellows elements such that no product can ingress between the carrier and the valve tappet or valve seat respectively on which the carrier is mounted. Among these embodiments are those in which the bellows elements also form a spring that defines a resting position for the carrier.

In some embodiments, an elastic ring-seal and a shoulder against which the ring seal lies in contact form sealing elements of the first seal-seat. For the sake of simplicity, the ring seal is preferably formed on the valve tappet, and the shoulder is a change of diameter, preferably a clearly perceptible change, at the valve seat. It is also possible, however, for the ring seal to be arranged at the valve seat, and for the shoulder to be on the valve tappet.

In some embodiments, the ring seal contains an annular seal-lip that extends transversely to the direction of the tappet's movement. Such a seal lip, due to its geometry and with the corresponding size of the annular gap in the axial portion between the valve tappet and the valve seat, has an adequate deformability such as to allow, after the contact at the shoulder, for a further axial movement of the valve tappet as far as the closure of the second seal-seat.

Preferably, the first seal-seat, after closing, allows for a further axial actuation of the valve tappet in the closing direction of at least 1 millimeter. This allows the time delay between the closing of the first seal-seat and the closing of the second seal-seat to be adjusted and set within wide limits.

Preferably, the further axial actuation path of the valve tappet after the closing of the first seal-seat amounts to 1.0-2.5 millimeters, preferably 1.5-2.5 millimeters. This further axial actuation path can be provided by controlling the filling device in conjunction with an actuation mechanism for the valve tappet.

In principle it is possible for the time delay between the closing of the first seal-seat and the closing of the second seal-seat to be achieved by simply moving the valve tappet further in a movement sequence. To speed up the filling process, and also to better control it, it is preferable for the actuation of the valve tappet to be realized by two separate movements: one to close the first seal-seat and another to close the second seal-seat. These can have two different movement speeds. This arrangement also permits the restraining the axial movement of the valve tappet for a brief period after having closed the first seal-seat.

In another aspect, the invention features a method that includes moving the valve tappet to first close the first seal-seat, and then moving it further to close the second seal-seat. Preferably, the time delay offset between the closing of the first seal-seat and the closing of the second seal-seat is 30-300 milliseconds. This is enough to prevent gas from penetrating into the annular gap of the axial channel and to prevent the escape of the product out of the axial channel.

It is to be clearly established that a filling device with at least one, and preferably a plurality, of the filling valves referred to heretofore, also comprises a movement mechanism for moving the valve tappet, a control arrangement, as well as a product feed with the corresponding product containers and product lines, and the necessary valves and control elements. The invention naturally also includes a filling device with at least one, and in some embodiments a plurality, of the filling valves described heretofore.

The exemplary embodiments of the invention referred to heretofore can be combined with one another in any desired manner.

BRIEF DESCRIPTION OF THE DRAWINGS

These and other features of the invention will be apparent from the following detailed description and the accompanying figures, in which.

DETAILED DESCRIPTION

Figure 1:
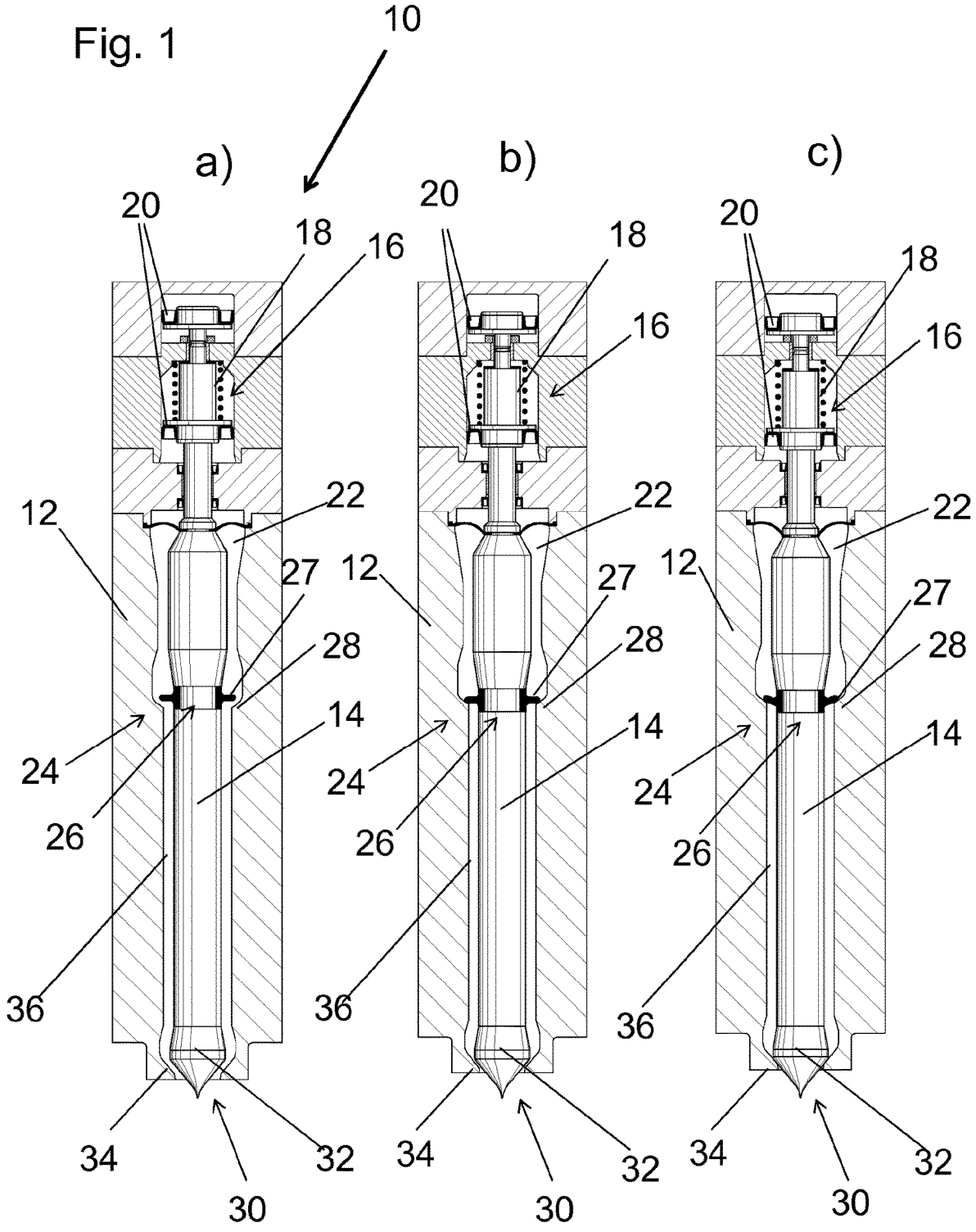
FIG. 1 shows a first embodiment of a filling valve according to the invention at three different times.

FIG. 1 shows a filling valve 10 having a valve seat 12 and a valve tappet 14 that is guided such as to be axially movable. At its upper end, the valve tappet 14 has a valve head 16 by which the valve tappet 14 is not only axially guided in the valve seat 12 but is also gripped by a movement mechanism for axial movement. Actuation elements 20 in the region of the valve head 16 permit a movement mechanism to grip the valve head 16.

A spring 18 in the region of the valve head 16 pre-tensions the valve tappet 14 into a resting position. As a rule, this is in the closing direction.

A product-delivery space 22 extends longitudinally between the valve seat and the valve tappet 14. This product-delivery space 22 receives liquid from a product-delivery device.

A lower end of the product-delivery space 22 has a first seal-seat 24. A ring seal 26 arranged on the valve tappet 14, a radially-extending seal-lip 27, and a shoulder 28 arranged on the valve seat 12 cooperate to form the first seal-seat 24 thus forming a sealing element for the product-delivery space 22.

At a lower end of the valve tappet 14 is a second seal-seat 30. The sealing elements of this second seal-seat 30 are formed by an enlarged-diameter drop-shaped thickening 32 of the valve tappet 14 and a seal edge 34 at the lower end of the valve seat 12. An axial portion 36 extends between the first and second seal-seats 24, 30. This axial portion 36 defines an annular gap through which the product delivered to the product delivery space 22 moves towards the second seal-seat 30, i.e. towards the lower outlet of the filling valve 10.

The highly elastic seal-lip 27 of the ring seal 26 extends outwards so that its outer edge contacts the shoulder 28 of the valve seat 12 in the closing position of the first seal-seat 24.

The function of the filling valve 10 at the end of a filling process is described hereinafter on the basis of FIGS. 1 and 2, each of which shows operation of the filling valve 10 at three different times, labeled "a," "b," and "c."

The "a" portion of FIG. 1 shows the position of the valve tappet 14 during the filling of a product. At this stage of the process, the seal lip 27 is spaced at a distance from the shoulder 28 of the valve seat 24 and the drop-shaped thickening 32 is spaced from the seal edge 34 of the second seal-seat 30. The product delivered to the product delivery space 22 can therefore flow unimpeded past the first seal-seat 24, past the second seal-seat 30, and into a container that would be located beneath the filling valve 10.

The "b" portion of FIG. 1 shows the first phase of filling cessation. In this first phase, the valve tappet 14 moves downward far enough to place the seal lip 27 into contact with the shoulder 28 of the valve seat 12. This closes the first seal-seat 24. Meanwhile, a gap remains at the second seal-seat 30, thus keeping it open. This remaining gap between the drop-shaped thickening 32 and the seal edge 34 is preferably between 0.5 and 1.5 millimeters.

This remaining gap acts as a gas barrier. As a result, no gas can penetrate into the annular gap 36 located above the second seal-seat 30. This therefore excludes the possibility of prematurely emptying the axial region or the annular gap respectively.

The "c" portion of FIG. 1 shows the second phase of filling cessation. In this second phase, the valve tappet 14 has moved further downwards so that the drop-shaped thickening 32 is in contact at the seal edge 34. This closes the second seal-seat 30. Both ends of the annular gap 36 have now been closed off: the upper end by the closed first seal-seat 24, and the lower end by the second seal-seat 30.

As the valve tappet 14 moves further downwards to close the second seal-seat 30, it severely deforms the elastic seal lip 27. As a result the seal lip 27 no longer extends radially outwards. Instead, it bends axially to form a plate-shaped structure. Nevertheless, due to its high elasticity, the seal lip 27 remains in contact at the shoulder 28. This means that the first seal-seat 24 continues to exert its sealing effect even after the valve tappet 14 has been moved downward to close the second seal-seat 30.

The filling valve 10 described herein promotes spray-free filling of products derived from liquid that contains solids, as well as for filling products of different viscosities.

The opening of the second seal-seat 30 for a new filling process runs in the reverse sequence. First, the tappet 14 moves upwards, thus opening the second seal-seat 30. However, the first seal-set 24 does not open immediately. There is a time delay. Only when the deformation of the seal lip 27 in FIG. 1 has been relieved does it actually rise up from the shoulder 28 of the first seal-seat 24 to thereby open the first seal-seat 24. This ensures that the first seal-seat 24 only opens after the second seal-seat 30 has already opened. The time delay between these openings can be adjusted again by the control arrangement of the filling device, and in particular, by controlling the valve tappet's movement.

Figure 2:
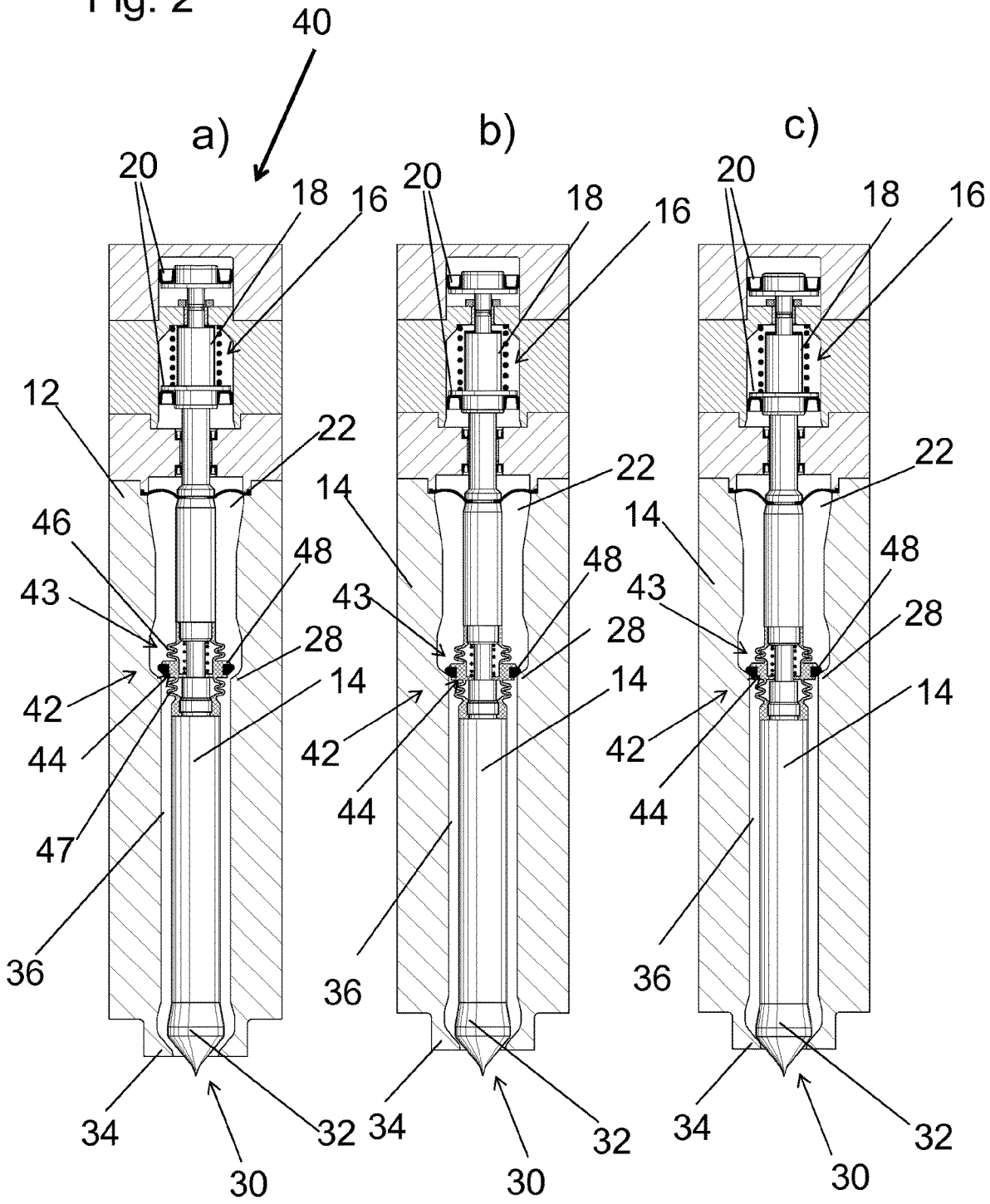
FIG. 2 is a perpendicular section through a second embodiment of the filling valve at the same times as shown in FIG. 1.

FIG. 2 shows a view similar to that shown in FIG. 1, but of a second exemplary embodiment of the invention in which identical or functionally similar parts are provided with identical reference numbers. The first seal-seat 42 of the filling valve 40 from FIG. 2 is configured differently from the first seal-seat 24 from FIG. 1.

The first seal-seat 42 of the filling valve 40 from FIG. 2 has, at the valve seat 14 thereof, a shoulder 28 that functions as a sealing surface. This arrangement is identical to that shown in FIG. 1.

In contrast with FIG. 1, however, arranged at the valve tappet 14 is an annular sealing element 43, with an axially displaceable carrier 44. The carrier 44 is held on the valve tappet 14 by an upper folding bellows element 46 and a lower folding bellows element 47 such as to be axially movable while being tightly connected by corresponding upper and lower portions of the valve tappet 14, and therefore sealed against the product. Although they can be configured as two pieces, it is useful if the two bellows elements 46, 47 are configured as one piece, as is represented in FIG. 2. The carrier 44 carries, on its outer circumference, a carrier-seal 48. Suitable seals include an O-ring seal and a flat seal. In either case, the carrier-seal 48, at the closing of the first seat seal 42, contacts the shoulder 28.

The sequence at the end of a filling is represented by analogy to FIG. 1. In part "a" of FIG. 2, the filling valve 40 is opened. In this configuration, both the first seal-seat 42 as and the second seal-seat 30 are opened.

When closing, the valve tappet 14 travels downwards. This means that the seal 48 contacts the shoulder 28 of the first seal-seat 42. However, when this occurs, there is still a gap of about one millimeter between the drop-shaped thickening 32 at the lower end of the valve tappet 14 and the seal edge 34 of the second seal-seat 30. As was the case in FIG. 1, this gap functions as a gas barrier that counteracts spraying of the product into a bottle located beneath it or onto the surrounding area.

In the second phase, the valve tappet 14 moves further downwards. As a result, the drop-shaped extension 32 comes to lie on its seal edge 34. This closes the second seal-seat 30.

At the opening of the filling valve 40 in FIG. 2, the second seal-seat 30 opens, and, with a further axial movement of the valve tappet 14 into the opening position, the annular sealing element 43 again moves into its resting position between the upper folding bellows element 46 and the lower folding bellows element 47, as shown in part "b" of FIG. 2. After this, further upward movement of the valve tappet 14 detaches the O-ring seal 48 from the shoulder 28. This opens the first seal-seat 42 so that a new filling process can begin.

The invention is not restricted to the exemplary embodiments represented, but can be varied within the scope of protection of the following claims.

The invention claimed is:

1. An apparatus comprising a filling valve, said filling valve comprising a valve seat, an axially-movable valve tappet extending through said valve seat and having an axial portion that defines a product-delivery space through which filling product flows, first seal-elements that cooperate to form a first seal-seat in response to axial movement of said valve tappet towards an opening of said filling valve, and second seal-elements that cooperate to form a second seal-seat, said second seal-seat being disposed downstream from said first seal-seat at an outlet end of said filling valve so that liquid product flows from said first seal-seat, through said product-delivery space, to said second seal-seat, wherein said first seal-elements comprise an elastic seal-element disposed to be deformed by axial movement of said valve tappet following formation of said first seal-seat, wherein said first seal-seat and said second seal-seat are fixed to said valve tappet in such a way that, in response to a closing movement of said valve tappet, said first seal-seat closes before said second seal-seat, and wherein said first seal-seat, after having been closed as a result of said closing movement, permits further axial movement of said valve tappet to permit closing of said second seal-seat.

2. The apparatus of claim 1, wherein said first seal-elements comprise an axially-displaceable seal-element that is arranged such that axial movement of said valve tappet drives axial displacement of said axially-displaceable seal element toward said opening of said filling valve.

3. The apparatus of claim 1, wherein said elastic seal-element is an annular seal, wherein said first seal-elements further comprise a shoulder against which a distal face of said annular seal rests, wherein said distal face faces said outlet.

4. The apparatus of claim 1, wherein said elastic seal-element is an annular seal that is fixed to said valve tappet and wherein said first seal-elements further comprise a shoulder on said inner wall against which a distal face of said annular seal makes contact.

5. The apparatus of claim 1, wherein said elastic seal-element is an annular seal having an annular lip that extends transversely to a direction along which said valve tappet moves during operation of said filling valve, wherein said lip extends beyond a width of said product-delivery space.

6. The apparatus of claim 1, wherein a function of the first seal seat is to allow at least one millimeter of further axial movement of said valve tappet after said first seal-seat has been closed, wherein, in order to carry out said function, said first seal seat possesses a structure, wherein said structure, is that of being configured to allow at least one millimeter of further axial movement of said valve tappet after said first seal-seat has been closed.

7. The apparatus of claim 1, wherein said first seal-seat is configured to allow between 1 millimeter and 2.5 millimeters of further axial movement of said valve tappet after said first seal-seat has been closed.

8. The apparatus of claim 1, wherein said first seal-seat is adapted to allow between 1.5 millimeters and 2.5 millimeters of further axial movement of said valve tappet after said first seal-seat has been closed.

9. The apparatus of claim 1, further comprising actuating elements in a region of a valve head to permit said valve head to be gripped for moving said valve tappet.

10. The apparatus of claim 1, wherein, as a result of said deformation, said first seal-elements open only after said second seal-elements have already opened.

11. The apparatus of claim 1, wherein, as a result of said deformation, said first seal-elements close before said second seal-elements have closed.

12. The apparatus of claim 1, further comprising a gas barrier that exists only when said second seal-elements open.

13. The apparatus of claim 1, wherein said valve tappet extends distally to a distal point and comprises a thickening proximal to said distal point.

14. The apparatus of claim 1, further comprising a spring that holds said valve tappet in a resting position, wherein said further movement is against a force exerted by said spring, and wherein, after said further movement, said spring restores said valve tappet to said resting position.

15. The apparatus of claim 1, wherein said second seal-element comprises a drop-shaped end of said valve tappet.

16. The apparatus of claim 1, wherein said first seal elements comprise a ring seal fixed on said valve tappet and wherein said ring seal and said valve tappet are configured to continue moving together even after said first seal-seat has been closed.

17. The apparatus of claim 1, wherein said valve tappet is configured to continue moving for between fifty and three hundred milliseconds after said first seal-seat has been closed.

18. A method for using an apparatus for filling a container with a liquid-filling product, wherein said apparatus comprises a filling valve, said filling valve comprising a valve seat, an axially-movable valve tappet extending through said valve seat and having an axial portion that defines a product-delivery space through which filling product flows, first seal-elements that cooperate to form a first seal-seat, and second seal-elements that cooperate to form a second seal-seat, said second seal-seat being disposed downstream from said first seal-seat at an outlet end of said filling valve so that liquid product flows from said first seal-set, through said product-delivery space, to said second seal-seat, wherein said first seal-elements comprise an elastic seal-element disposed to permit deformation in response to axial movement of said valve tappet, wherein said first seal-seat and said second seal-seat are fixed to said valve tappet in such a way that, in response to a closing movement of said valve tappet, said first seal-seat closes before said second seal-seat, and wherein said first seal-seat, after having been closed as a result of said closing movement, permits further axial movement of said valve tappet to permit closing of said second seal-seat, wherein said method comprises delivering said liquid filling-product to said filling valve, moving said valve tappet along an axial direction of said filling valve to thereby cause first and second seal-seats thereof to undergo a state transition at times separated by a time delay, said state transition being selected from the group consisting of a transition from an open state to a closed state and a transition from a closed state to an open state.

19. An apparatus comprising a filling valve of a filling device for filling products containing a liquid, comprising at least one valve tappet, which is arranged in a valve seat in an axially movable manner, wherein an axial portion is formed between the valve seat and valve tappet, in which the product flows to a second seal seat that is formed at an outlet end of the filling valve, in which filling valve a first valve seat, connected to the axial portion, is fixed upstream of the second seal seat in the flow direction, said first seal seat comprising sealing elements that interact with one another, wherein the first seal seat and second seal seat are arranged at the valve tappet in such a way that the first seal seat closes before the second seal seat during a closing movement of the valve tappet, wherein the first seal seat, after the closing, allows for a further axial movement of the valve tappet in the closing direction until the second seal seat is closed, wherein at least one of the sealing elements is elastic, and in the actuation direction allows for a deformation in the size of the further axial movement of the valve tappet.

20. The apparatus of claim 1, wherein said elastic seal-element is disposed to deform to an extent that corresponds to an extent of said further axial movement of said valve tappet.

* * * * *